United States Patent [19]

Hausermann et al.

[11] Patent Number: 4,493,165

[45] Date of Patent: Jan. 15, 1985

[54] ORBITAL POLISHER WITH ELASTIC ABRASIVE

[75] Inventors: Marten C. Hausermann, Addison; Elmer P. Hausermann, Bensenville, both of Ill.

[73] Assignee: Hausermann Abrading Process Company, Addison, Ill.

[21] Appl. No.: 474,150

[22] Filed: Mar. 10, 1983

[51] Int. Cl.[3] ..... B24B 19/00

[52] U.S. Cl. ..... 51/58; 51/157

[58] Field of Search ..... 51/59 SS, 58, 60, 157, 51/358, 394

[56] References Cited

U.S. PATENT DOCUMENTS

| | | | |
|---|---|---|---|
| Re. 27,588 | 2/1973 | Hausermann | 51/58 |
| 1,238,883 | 9/1917 | Burlew | 51/394 |
| 2,804,724 | 9/1957 | Thatcher | 51/59 SS |
| 3,400,501 | 9/1968 | Chaumont | 51/358 |
| 3,909,217 | 9/1975 | Perry | 51/306 |
| 3,924,362 | 12/1975 | McAleer | 51/358 |
| 4,100,701 | 7/1978 | Bessaguet | 51/59 SS |

*Primary Examiner*—Harold D. Whitehead

*Attorney, Agent, or Firm*—Robert F. Van Epps

[57] ABSTRACT

Apparatus for polishing a workpiece wherein an oversize resilient elastomeric polishing die has injector ports through which a viscous or elastic polishing medium is injected. The workpiece is mounted in vertical working alignment with respect to the polishing die. The die and workpiece are moved relative to one another in a horizontal oscillatory rotary motion as they are brought together in the vertical direction such that the workpiece surfaces are polished.

3 Claims, 1 Drawing Figure

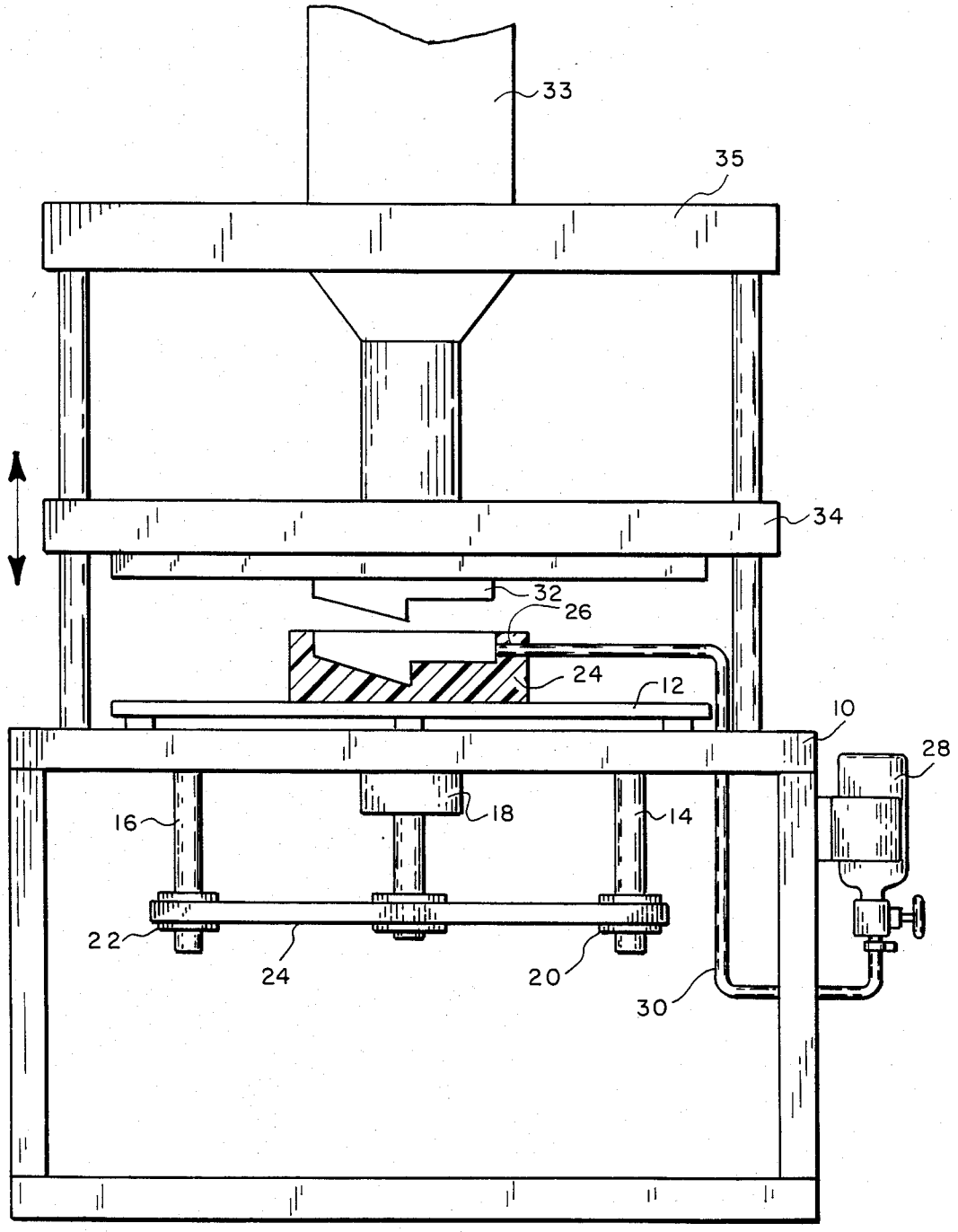
33
35
34
32
26
24
12
10
28
16
18
14
22
24
20
30

ORBITAL POLISHER WITH ELASTIC ABRASIVE

BACKGROUND OF THE INVENTION

1. Field of the Invention

The present invention relates generally to the field of polishing and more particularly to an improved orbital polishing apparatus.

2. Description of the Prior Art

Prior to the present invention a method and apparatus for forming electric discharge machining electrodes by an abrasion process were disclosed in U.S. Pat. Nos. 3,663,783 entitled Method of Erosively Shaping a Master Die and U.S. Pat. No. Re. 27,588 entitled Apparatus for Shaping Electrodes, respectively. The method and the appratus for its implementation involve the use of an abrasive die and an electrode workpiece mounted in vertical working alignment with one another. The die and workpiece are moved relative to one another in a horizontal oscillatory rotary motion as they are brought together in the vertical direction.

The applicant has found that the basic structure and horizontal and vertical drive arrangement of the abrading machine may be used to advantage as apparatus to polish metal workpieces.

OBJECTS AND SUMMARY OF THE INVENTION

From the preceding discussion it will be understood that among the various objectives of the present invention are included:

the provision of a new and improved apparatus for polishing metal workpieces; and the provision of apparatus of the above-described character using relative orbital motion of the workpiece and an elastomeric polishing die.

These and other objectives of the present invention are efficiently achieved by providing an oversize elastomeric polishing die and workpiece mounted in vertical working alignment with one another. The die and workpiece are moved relative to one another in a horizontal oscillatory rotary motion as they are brought together in the vertical direction. A viscous and/or elastic polishing medium is injected into the polishing die during the relative motion such that the surfaces of the workpiece are quickly and efficiently polished.

The foregoing as well as other objects, features and advantages of the present invention will become more apparent from the following detailed description taken in conjunction with the appended drawing.

BRIEF DESCRIPTION OF THE DRAWING

The single appended FIGURE is a simplified elevation view of an orbital polishing machine in accordance with the applicant's invention.

DESCRIPTION OF PREFERRED EMBODIMENT

Turning now to the FIGURE there is shown a simplified elevation view of a polishing machine in accordance with the principles of the present invention. The basic elements of the machine include a base member 10 which supports a lower platen 12 which is free to move in any direction in the horizontal plane with respect to the base member 10. The lower platen 12 is driven in horizontal oscillatory rotary motion by first and second eccentrically mounted spindles 14 and 16 which are synchronously driven in rotation about their longitudinal axes by a drive motor 18 through pulleys 20 and 22 and belt 20. The drive mechanism is only schematically shown, however, for a more detailed description reference may be had to U.S. Pat. No. 4,277,915 entitled Apparatus for Shaping Electrodes which issued to Marten C. Hausermann and Melvin V. Mues on July 14, 1981.

To the lower platen 12 is mounted an elastomeric polishing die 24 formed in the shape of the workpiece to be polished and oversized with respect thereto by a preselected amount. The polishing die, in the context of the present invention, is not itself abrasive as in an abrading machine. Rather it is formed of a relatively resilient material such as a urethane. The degree of resiliency of the polishing die material will vary depending upon the polishing accuracy required for a particular job. The applicant has found that such materials as a polyurethane elastomer commerically available from Ren Plastics, a Ciba-Geigy Company of Lansing, Mich. under the trademark PEN:C:O-THANE is useful in the practice of the invention.

The polishing die 24 is provided with at least one injector port 26 to which is coupled a supply 28 of viscous or elastic polishing medium via hose 30. The polishing medium is injected under controlled pressure into the polishing die 24. Again, the type of polishing medium will vary with the nature of the particular polishing operation, but by way of example, the applicant has found that a flowable abrasive composition as described in U.S. Pat. No. 3,909,217 and commerically available from Dynetics Corp. of Woburn, Mass., under the trademark Dynaflow is particularly well suited for certain operations.

The workpiece 32 is mounted to an upper platen 34 in a superimposed relation to the polishing die 24. The upper platen 34 is coupled through a vertical drive mechanism 36 to the superstructure 38 of the polishing machine such that upper platen 34 may be driven in the vertical dimension such as to bring the workpiece 32 into contact with the polishing die 24. The vertical drive mechanism may, for example, be a hydraulic ram 33, affixed to the machine superstructure 35, as illustrated, or, in the alternative, a manually operated mechanism such as described in the applicant's co-pending application Ser. No. 441,741 filed on Nov. 18, 1982, could be used.

When the workpiece 32 is driven into contact with the polishing die 24 as the latter is being driven in horizontal oscillatory rotary motion and the polishing medium is injected into the polishing die 24 particles of the medium are engaged by the resilient surface of the die and moved over the surface of the workpiece to effect the polishing. As with abrading, the polishing operation is effected in a series of incremental steps. Due to the combined resiliency of the polishing die and the viscous nature of the polishing medium the distribution of the medium over the surface of the die varies randomly from step to step. Hence, circular polishing marks which would otherwise be anticipated due to the nature of the relative motion of the polishing die 24 and workpiece 32 are substantially avoided. By adjusting the elasticity of the polishing medium, the frictional adherence of the medium to the polishing die and the amplitude and speed of the orbital motion, the apparatus may be made to perform a variety of polishing operations with a high degree of efficiency. It has been found that metal workpieces of highly complex shape which in the prior art required hand finishing can be quickly and efficiently polished in the applicant's machine.

From the foregoing discussion it will be understood that the applicant has provided a new and useful apparatus for polishing metal workpieces whereby the objectives set forth hereinabove are efficiently achieved. Since certain changes in the above-described construction will occur to these skilled in the art without departure from the scope of the invention, it is intended that all matter set forth in the preceding description or shown in the appended drawing shall be interpreted as illustrative and not in a limiting sense.

Having described what is new and novel and desired to secure by Letters Patent, what is claimed is:

1. Apparatus for polishing workpieces, said apparatus comprising a base member;

a first platen disposed on and supported by said base member and free to move in any direction in the horizontal plane with respect to said base member;

means coupled to said first platen for driving said first platen in horizontal oscillatory rotary motion with respect to said base member;

a resilient, non-abrasive polishing die fixed to the upper surface of said first platen;

a second platen mounted in a superimposed relation and adapted to be driven vertically with respect to said first platen;

means for mounting a workpiece to said second platen in substantial vertical alignment with said resilient polishing die;

vertical drive means for incrementally infeeding said workpiece and said polishing die into contact with one another while said first platen is driven in horizontal oscillatory motion;

means for injecting an elastic abrasive composition into said polishing die when said workpiece is in contact therewith.

2. Apparatus as recited in claim 1 wherein said resilient polishing die is formed of a polyurethane elastomer.

3. Apparatus as recited in claim 1 wherein said means for driving said first platen in horizontal oscillatory rotary motion comprises a plurality of eccentrically mounted spindles each coupled at one end to the lower surface of said first platen, and means for synchrounously driving said spindles in rotation about the longitudinal axes thereof.

* * * * *